US006460547B1

(12) United States Patent
Williams

(10) Patent No.: US 6,460,547 B1
(45) Date of Patent: Oct. 8, 2002

(54) HAIR PIN

(76) Inventor: Sheila M. Williams, 5045 Juiata Dr., Birminghan, AL (US) 35210

( * ) Notice: Subject to any disclaimer, the term of this patent is extended or adjusted under 35 U.S.C. 154(b) by 0 days.

(21) Appl. No.: 10/006,870

(22) Filed: Oct. 26, 2001

(51) Int. Cl.[7] ..... A45D 24/06
(52) U.S. Cl. ..... 132/280
(58) Field of Search ..... 132/280, 281, 132/282, 283, 284; D28/39, 40; 24/67.9, 546

(56) References Cited

U.S. PATENT DOCUMENTS

| | | | | | |
|---|---|---|---|---|---|
| 848,048 | A | | 3/1907 | Pryce-Jones | |
| 1,281,469 | A | * | 10/1918 | Wood | 24/546 |
| 1,337,377 | A | * | 4/1920 | Wilson | 132/280 |
| 1,594,933 | A | * | 8/1926 | Durand | 132/281 |
| 1,605,433 | A | | 11/1926 | Gibson | |
| 1,637,492 | A | | 8/1927 | Lui | |
| 1,994,248 | A | | 3/1935 | Hermsdorf | |
| 2,664,899 | A | * | 1/1954 | Attias | 132/281 |
| 3,039,647 | A | * | 6/1962 | Rasmussen | 24/546 |
| 3,194,248 | A | * | 7/1965 | Callies | 132/281 |
| 3,330,287 | A | * | 7/1967 | Muhs | 132/281 |
| 3,540,491 | A | | 11/1970 | Solomon | |
| 3,930,511 | A | * | 1/1976 | Roney | 132/281 |
| D347,295 | S | | 5/1994 | Mccabe et al. | |

* cited by examiner

*Primary Examiner*—Todd E. Manahan

(57) ABSTRACT

A hair pin for gripping the hair of a user for placing it against the head of the user. The hair pin includes a strand of wire formed of a resilient material having a first leg and a second leg joined together by a first bend. The first bend is U-shaped. Each of the legs has a free end. The first leg has a second bend therein positioned nearer to the free end than such that a third leg is defined between the second bend and the free end of the first leg. A total length of the first and third legs is generally equal to a length of the second leg. The first, second and third legs lying generally in the same plane.

5 Claims, 1 Drawing Sheet

HAIR PIN

BACKGROUND OF THE INVENTION

1. Field of the Invention

The present invention relates to hair pins and more particularly pertains to a new hair pin for gripping the hair of a user for placing it against the head of the user.

2. Description, of the Prior Art

The use of hair pins is known in the prior art. More specifically, hair pins heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,540,491; U.S. Pat. No. 1,992,248; U.S. Pat. No. 1,637,492; U.S. Pat. No. 1,605,433; U.S. Pat. No. 848,048; and U.S. Des. Pat. No. 347,295.

While these devices fulfill their respective, particular objectives and requirements, the aforementioned patents do not disclose a new hair pin. The inventive device includes a strand of wire formed of a resilient material having a first leg and a second leg joined together by a first bend. The first bend is U-shaped. Each of the legs has a free end. The first leg has a second bend therein positioned nearer to the free end than such that a third leg is defined between the second bend and the free end of the first leg. A total length of the first and third legs is generally equal to a length of the second leg. The first, second and third legs lying generally in the same plane.

In these respects, the hair pin according to the present invention substantially departs from the conventional concepts and A designs of the prior art, and in so doing provides an apparatus primarily developed for the purpose of gripping the hair of a user for placing it against the head of the user.

SUMMARY OF THE INVENTION

In view of the foregoing disadvantages inherent in the known types of hair pins now present in the prior art, the present invention provides a new hair pin construction wherein the same can be utilized for gripping the hair of a user for placing it against the head of the user.

The general purpose of the present invention, which will be described subsequently in greater detail, is to provide a new hair pin apparatus and method which has many of the advantages of the hair pins mentioned heretofore and many novel features that result in a new hair pin which is not anticipated, rendered obvious, suggested, or even implied by any of the prior art hair pins, either alone or in any combination thereof.

To attain this, the present invention generally comprises a strand of wire formed of a resilient material having a first leg and a second leg joined together by a first bend. The first bend is U-shaped. Each of the legs has a free end. The first leg has a second bend therein positioned nearer to the free end than such that a third leg is defined between the second bend and the free end of the first leg. A total length of the first and third legs is generally equal to a length of the second leg. The first, second and third legs lying generally in the same plane.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hair pin apparatus and method which has many of the advantages of the hair pins mentioned heretofore and many novel features that result in a new hair pin which is not anticipated, rendered obvious, suggested, or even implied by any of the prior art hair pins, either alone or in any combination thereof.

It is another object of the present invention to provide a new hair pin which may be easily and efficiently manufactured and marketed.

It is a further object of the present invention to provide a new hair pin which is of a durable and reliable construction.

An even further object of the present invention is to provide a new hair pin which is susceptible of a low cost of manufacture with regard to both materials and labor, and which accordingly is then susceptible of low prices of sale to the consuming public, thereby making such hair pin economically available to the buying public.

Still yet another object of the present invention is to provide a new hair pin which provides in the apparatuses and methods of the prior art some of the advantages thereof, while simultaneously overcoming some of the disadvantages normally associated therewith.

Still another object of the present invention is to provide a new hair pin for gripping the hair of a user for placing it against the head of the user.

Yet another object of the present invention is to provide a new hair pin which includes a strand of wire formed of a resilient material having a first leg and a second leg joined together by a first bend. The first bend is U-shaped. Each of the legs has a free end. The first leg has a second bend therein positioned nearer to the free end than such that a third leg is defined between the second bend and the free end of the first leg. A total length of the first and third legs is generally equal to a length of the second leg. The first, second and third legs lying generally in the same plane.

Still yet another object of the present invention is to provide a new hair pin that has elastomeric bulbous members for holding the device in hair in a more secured manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
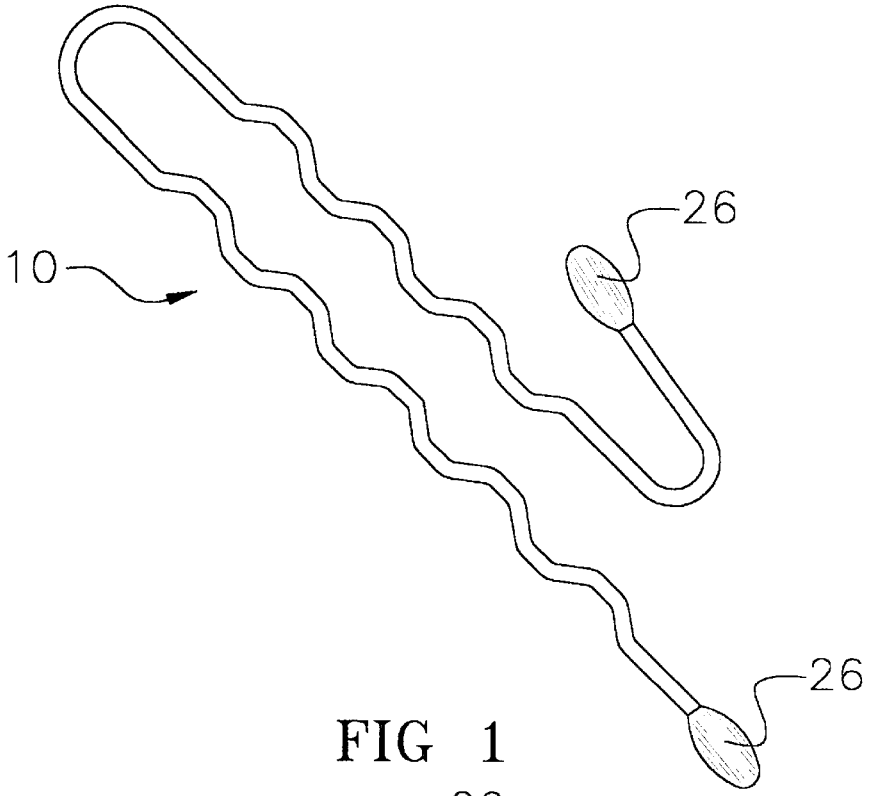
FIG. 1 is a schematic plan view of a new hair pin according to the present invention.
Figure 2:
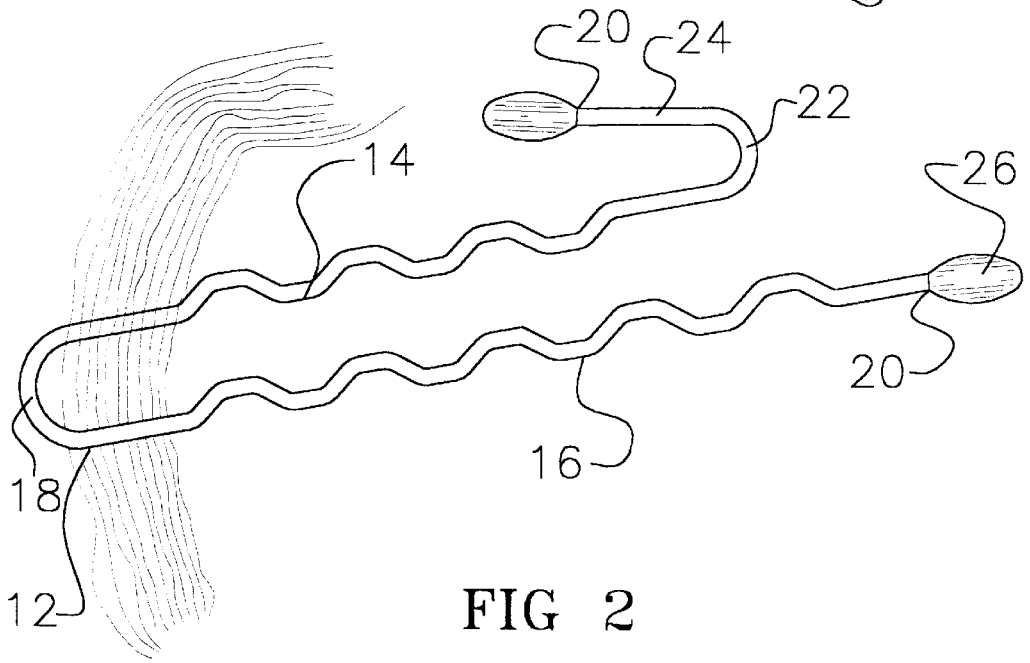
FIG. 2 is a schematic plan view of the present invention.

With reference now to the drawings, and in particular to FIGS. 1 and 2 thereof, a new hair pin embodying the principles and concepts of the present invention and generally designated by the reference numeral 10 will be described.

As best illustrated in FIGS. 1 and 2, the hair pin 10 generally comprises a strand of wire 12 formed of a resilient material having a first leg 14 and a second leg 16 joined together by a first bend 18. The first bend 18 is a U-shaped bend. Each of the legs 14, 16 has a free end 20. The first leg 14 has a second bend 22 therein positioned nearer to the free end 20 than the first bend such that a third leg 24 is defined between the second bend 22 and the free end 20 of the first leg 14. A total length of the first 14 and third 24 legs being generally equal to a length of the second leg 16. The first 14, second 16 and third 24 legs lie generally in the same plane. Each of the first 14 and second 16 legs is crimped.

Each one of a pair of the bulbous members 26 is attached to one of the free ends. Each of the bulbous members 26 comprises an elastomeric material.

In use, device is positioned in the hair such that the hair is positioned between the first and second legs. The third leg aids in holding the pin in place. The elastomeric bulbous members create friction between the device and the hair for further aiding in keeping the device in the hair.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair gripping fastener comprising: a strand of wire formed of a resilient material having a first leg and a second leg joined together by a first bend, said first bend being U-shaped, each of said legs having a free end, said first leg having a second bend therein positioned nearer to said free end than said first bend such that a third leg is defined between said second bend and said free end of said first leg, said second bend forming an arc of between 160 and 190 degrees such that the third leg is substantially parallel with the first leg, a total length of the first and third legs being generally equal to a length of the second leg, said first, second and third legs lying generally in a plane.

2. The hair gripping fastener as in claim 1, wherein each of said first and second legs each are crimped.

3. The hair gripping fastener as in claim 1, further including a pair of bulbous members, each of said bulbous members being attached to one of said free ends.

4. The hair gripping fastener as in claim 3, wherein each of said bulbous members comprises an elastomeric material.

5. A hair gripping fastener comprising:

a strand of wire formed of a resilient material having a first leg and a second leg joined together by a first bend, said first bend being U-shaped, each of said legs having a free end, said first leg having a second bend therein positioned nearer to said free end than said first bend such that a third leg is defined between said second bend and said free end of said first leg, said second bend forming an arc of between 160 and 190 degrees such that the third leg is substantially parallel with the first leg, a total length of the first and third legs being generally equal to a length of the second leg, said first, second and third legs lying generally in a plane, each of said first and second legs each being crimped; and a pair of bulbous members, each of said bulbous members being attached to one of said free ends, each of said bulbous members comprising an elastomeric material.

* * * * *